US005370592A

United States Patent [19]

Wu

[11] Patent Number: 5,370,592

[45] Date of Patent: Dec. 6, 1994

[54] MODIFIED MECHANISM FOR THE ADJUSTING VALVE ON THE HYDRAULIC CYLINDER OF A STEPPER

[75] Inventor: Chun-Liang Wu, Chungli,

[73] Assignee: Cheng-Shiung Chang, Hsinchu, Taiwan, Prov. of China

[21] Appl. No.: 179,202

[22] Filed: Jan. 10, 1994

[51] Int. Cl.[5] ..... A63B 23/06; A63B 21/008

[52] U.S. Cl. ..... 482/53; 482/112

[58] Field of Search ..... 482/51, 52, 53, 111, 482/112, 113, 148; 601/27, 34, 35; 137/625, 599, 505

[56] References Cited

U.S. PATENT DOCUMENTS

| | | | |
|---|---|---|---|
| 3,529,474 | 9/1970 | Olson et al. | 482/113 |
| 5,129,450 | 7/1992 | Hung | 482/53 |
| 5,169,361 | 12/1992 | Hsu | 482/111 |
| 5,183,449 | 2/1993 | De Cloux | 482/53 |
| 5,236,407 | 8/1993 | Wang | 482/113 |
| 5,261,867 | 11/1993 | Chen | 482/53 |
| 5,277,682 | 1/1994 | Chen | 482/113 |

*Primary Examiner*—Stephen R. Crow

*Attorney, Agent, or Firm*—Morton J. Rosenberg; David I. Klein

[57] ABSTRACT

This invention provides for a modified mechanism for an adjusting valve coupled to a hydraulic cylinder of a stepper exercise type machine. In particular, there is provided a rotational joint mounted on opposing ends of a valve with a flexible duct located between the opposing joints. A ball roller contacts the flexible duct within the valve responsive to a rotation of a pressure adjusting rod. The rotational joints on opposing ends of the valve may be mounted directly to the oil guide holes of respective hydraulic cylinders or positionally fitted to an extension duct. In this manner, the distance between the hydraulic cylinders may be adjusted by the manufacturer or user and through use of the flexible duct allows the hydraulic cylinders to alternately provide rotative displacement.

1 Claim, 8 Drawing Sheets

MODIFIED MECHANISM FOR THE ADJUSTING VALVE ON THE HYDRAULIC CYLINDER OF A STEPPER

BACKGROUND OF THE INVENTION

This invention is to provide a modified mechanism for the adjusting valve on the hydraulic cylinder of a stepper. Particularly for an unprecedented modified mechanism for the adjusting valve on the hydraulic cylinder of a stepper with compact design, easy and convenient installation and operation. It makes the two hydraulic cylinders with varied setting distance can be applied so that it can be operated with multi-function. It also let the two hydraulic cylinders can swing freely and have actual leakage prevention effect. It makes the adjustment of the flow amount between two hydraulic cylinders be with compactness, practicability. It makes the manufacture of the valve be compact, convenient, swift and economic. It meets the requirements of practical usability, ideality and improvement.

There are many kinds of steppers for exercise use. The methods to install two hydraulic cylinders 2 (2') are primarily divided into two types. One is fixed type, as shown in FIG. 1, the relative distance of which is narrower. The other is a mobile type, as shown in FIG. 2, the relative distance of which is wider and the hydraulic cylinders can swing alternately. In order to have the exerciser step on the paddles 4 (4') of the stepper to do exercise, the oil in these two hydraulic cylinders 2 (2') can flow into each other and can adjust the amount of the flow. Between the two hydraulic cylinders, there is a pressure adjusting valve 3 installed to adjust the standing force for exercise. The mechanism made of the pressure adjusting valve 3 is shown as FIG. 3-1, FIG. 3-2. It is mainly composed of a valve 31 and a adjusting rod 32. The both ends of the valve 31 are fitted with the joints 311 which is with inner thread or outer thread so that they can be fitted to the two hydraulic cylinders respectively by some kind of medium. In the center, there is a flow guide hole 312, and in the middle part there is a positioning tenon 313 with appropriate height. In addition to have a thread part 3131 with appropriate length fitted at the outer periphery of the upper end of the positioning tenon 313 for the positioning cap to lock on, there is a guide hole 3132 which extends downward with appropriate depth in the center. At the lower end of the guide hole 3132, there is a pressure adjusting rod 32 fitted orderly with a thread part 3133 and a conic part 3133 through the guide hole 312. In addition to have a rotational handle 321 fitted at the top of the pressure adjusting rod 32, below its middle part, there is orderly fitted with a ring groove 322 for leakage ring (a) to position and a thread part 323 for screwing and a conic head 324 which can just contact closely to the conic part 3134 of the guide hole of the valve 31. When the exerciser turns the handle 321 and make the pressure adjusting rod 32 lift up, as shown in FIG. 3-2, the conic head 324 of the pressure adjusting rod 32 will leave from the conic part 3134 of the guide hole 3132 of the valve and makes the guide hole 312 on. Contrarily, when the pressure adjusting rod 32 lower down, as shown in FIG. 3-1, the conic head 324 will contact the conic part 3134 of the guide hole 3132 of the valve and the guide hole 312 of the valve 31 will be blocked off. In other words, the pressure adjusting valve 3 is controlled by the area or the contact surface between the conic head 324 of the adjusting rod 32 and the conic part 3134 of the guide hole of the valve to decide the amount of the oil flow between two hydraulic cylinders 2 (2'). For applying on the adjustment and control of the hydraulic pressure of the hydraulic cylinders of the stepper, by using the match of the conic part 3134 at the lower end of the guide hole 3132 of the valve and the conic head at the lower end of the pressure adjusting rod 32 to decide the flow amount of the hydraulic cylinders, the mechanism provides the effect of usability and it is also the most common style. However, when put in practice, it is found that there are still some defects to be improved, which are when the pressure adjusting rod 32 is lifting up or lowering down, it needs the close match between the conic head 324 at its lower end and the conic part 3134 of the guide hole 3132 of the valve so that the oil amount of flowing in or out can be controlled precisely. (If the match is not precise enough, the oil flow will not be stable, even the blocked off condition can not be reached). Therefore, the manufacture and installation of the conic head 324 of the pressure adjusting rod 32 and the conic part 3134 of the guide hole 3132 of the valve have to be very accurate and smooth. Obviously, the cost to make them will be higher and the production speed will be slower and the defect rate in production is likely to be higher. In particular, when in boring the guide hole 312, the connecting part between the guide hole 312 and the conic part 3134 of the guide hole will have raspy edge. Obviously, it will have direct influence to the match between the conic head 324 of the pressure adjusting rod and the conic part 3134 of the guide hole of the valve. Even it is likely cause the leakage because they can not have close contact. Of cause, the raspy edge can be removed; however, this, when in practice, is a troublesome, inconvenient, time consuming and uneconomic task. The set up or the above mentioned pressure adjusting valve is that the direct set up can be done in the fixed condition when the distance between two hydraulic cylinders is narrower, as shown in FIG. 1. When it is in the condition of free swing, as shown in FIG. 2, the distance between two cylinders is wider and it needs to use some other special mediums to connect in order to work. In other words, the method to connect the pressure adjusting valve and the two hydraulic cylinders or a traditional stepper is to use the rotational joints to set up the free rotation positioning of the two cylinders and to connect an exposed flexible duct with appropriate length between the oil guide hole and the pressure adjusting valve. By using the flexibility of the two flexible ducts, the two hydraulic cylinders can be operated with swinging and oil flowing into each other when in stepping exercise condition. Although, this way can get the expected operational purpose, its major disadvantage is that the two exposed ducts are easily to be touched by the exerciser and cause the damage or loose of oil seal and have leakage occur, which makes the manufacturers feel very inconvenient. In order to improve this mentioned disadvantage, some manufacturers here have ever proposed a mechanism as shown in FIG. 2, FIG. 4 and FIG. 5. Its particular is that at the both ends of the traditional pressure adjusting valve 3, connecting a hydraulic pipe 8 (8') respectively. At the other ends of these two hydraulic pipes 8 (8'), there is providing with the positioning for connecting to two hydraulic cylinders 2 (2'). At the joints between them and the hydraulic cylinders 2 (2'), there is fitted with a oil hole 89 (89') respectively which connects to the center longitudinal hole 81 (81'). Besides, at the joint ring of the hydraulic cylinder 221 (221') which provides the positioning of the hydraulic tube 8 (8'), there is fitted with a ring groove 2221 (2221') which is homologous to the hydraulic pipe oil hole 89 (89'). In other words, when one end of each hydraulic pipe 8 (8') is connected to each end of the pressure adjusting valve 3 respectively, and the other end is matched with the oil seal 72, 73 (72', 73') and positioning buckle 71, 74 (71', 74') and are positioned loosely at the joint rings 221 (221') of the two hydraulic cylinders, these two hydraulic cylinders 2 (2') can be the basis of the positioning of the two hydraulic pipe 8 (8') directly to have swinging movement. In addition, the oil in them can flow to each other by the ring groove 2221 (2221'), oil hole 89 (89'), the longitudinal hole of hydraulic tube 81 (81') and the pressure adjusting valve together. Irrefragably, this kind of process can improve the defect that the exposed flexible duct is easily to get loose. Nevertheless, we know that because the employed pressure adjusting valve 3 is completely the same as the traditional one and is without any change. In particular, the both ends of the pressure adjusting valve support the hydraulic pips 8 (8') of the hydraulic cylinders 2 (2') respectively. They must have the characteristics of guiding oil and for the swinging of the two hydraulic cylinders 2 (2'). Naturally, their set up must be accurate and smooth. And the set up of the corresponding joint rings 221 (221') of the hydraulic cylinders (including the ring grooves 2221 (2221')) must be accurate and smooth too. Therefore, in practical manufacturing, it is obviously with troublesome, inconvenience, time consuming and diseconomy. Moreover, when these two hydraulic cylinders 2 (2') are in continuously swinging, the set up of the inner seal 73 and outer seal 72 is easily to be derogated, damaged and may cause oil leakage.

According to the above description, the set up and operation of the pressure adjusting valve of the traditional stepper is obviously with the defect in practice and needs to be improved.

Therefore, in order to improve the mentioned defect practically and effectively and to make the operation of the pressure adjusting valve more applicability and ideality. The inventor takes the advantage of his experience of developing and manufacturing varied kinds of valves, studies hard and uses the related knowledge and provides this invention.

SUMMARY OF THE INVENTION

The main purpose of this invention is to provide a modified mechanism for the adjusting valve on the hydraulic cylinder of a stepper. Particularly for freely rotational joints fitted on both ends of a valve, Its characteristic is that the two freely rotational joints at both ends of the valve are fitted directly or fitted with another extension duct on the oil hole of two hydraulic cylinders. Therefore, the two hydraulic cylinders will keep at the setting distance and can be adjusted readily. Meanwhile, they can swing alternately and have the effect of free rotation.

Another purpose of this invention is to provide a modified mechanism for the adjusting valve on the hydraulic cylinder of a stepper. Because the flexible duct fitted between the two joints and the center of the valve, it has very good close contact effect due the fact that it is formed integrally and has a constant deflection force for rotation and twist so that the hydraulic oil in the two cylinder can not only flow into each other, but also can swing alternately at the same length (about in 15 degree of swinging) which can avoid the oil leakage.

A further purpose of this invention is to provide a modified mechanism for the adjusting valve on the hydraulic cylinder of a stepper. Here, the flexible duct is pushed directly by the ball roller fitted at the front end of the pressure adjusting rod at the time then the pressure adjusting rod is lifting up or lowering down and the flexible is turned to be slightly open or slightly closed or completely closed. Therefore, the amount adjustment of the oil flow between two hydraulic cylinders can be reached directly, simply, and practically. In particular, the manufacture of the valve and the hydraulic rod can get the effect of compactness, convenience, swiftness and economy.

Another purpose of this invention is to provide an unprecedented modified mechanism for the adjusting valve on the hydraulic cylinder of a stepper with compact design, easy and convenient installation and operation. It makes the two hydraulic cylinders with varied setting distance can be applied so that it can be operated with multi-function. It also let the two hydraulic cylinders can swing freely and have actual leakage prevention effect. It makes the adjustment or the flow amount between two hydraulic cylinders be with compactness, practicability. It makes the manufacture of the valve be compact, convenient, swift and economic. It conforms to practical usability, ideality and improvement.

BRIEF DESCRIPTION OF THE INVENTION

FIG. 3-1 is the two dimensional section delineation of a traditional pressure adjusting valve in off condition.

FIG. 3-2 is the two dimensional section delineation of a traditional pressure adjusting valve in on condition.

FIG. 8-1 is the two dimensional section delineation (1) of the pressure adjusting valve of this invention in on condition.

FIG. 8-1 is the two dimensional section delineation (1) of the pressure adjusting valve of this invention in off condition.

DETAIL DESCRIPTION OF THE INVENTION

Figure 6:
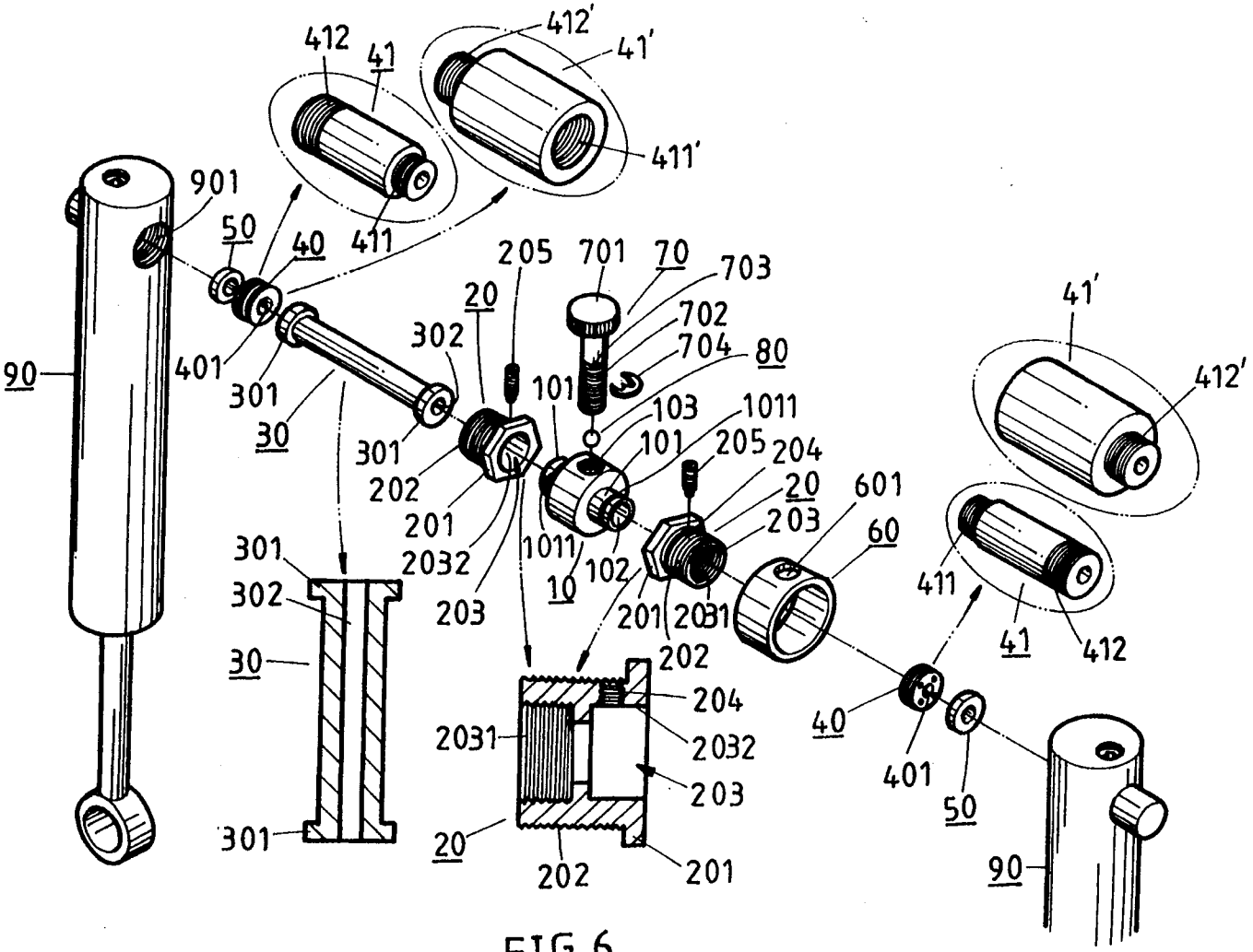
FIG. 6 is the disassemble diagram of the pressure adjusting valve and two hydraulic cylinders of this invention.
Figure 7:
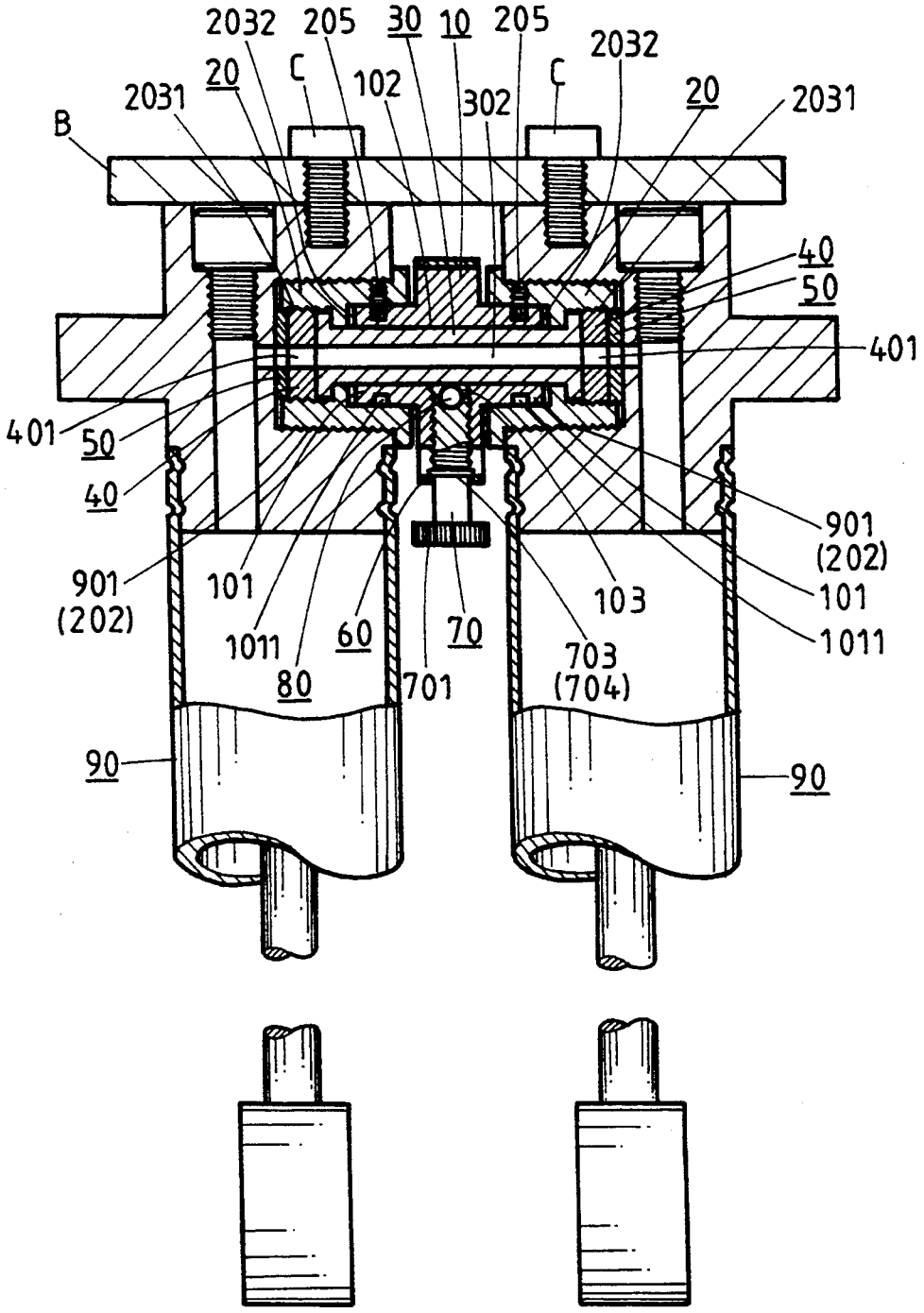
FIG. 7 is the two dimensional section delineation (1) of the pressure adjusting valve and two hydraulic cylinders of this invention.
Figure 9:
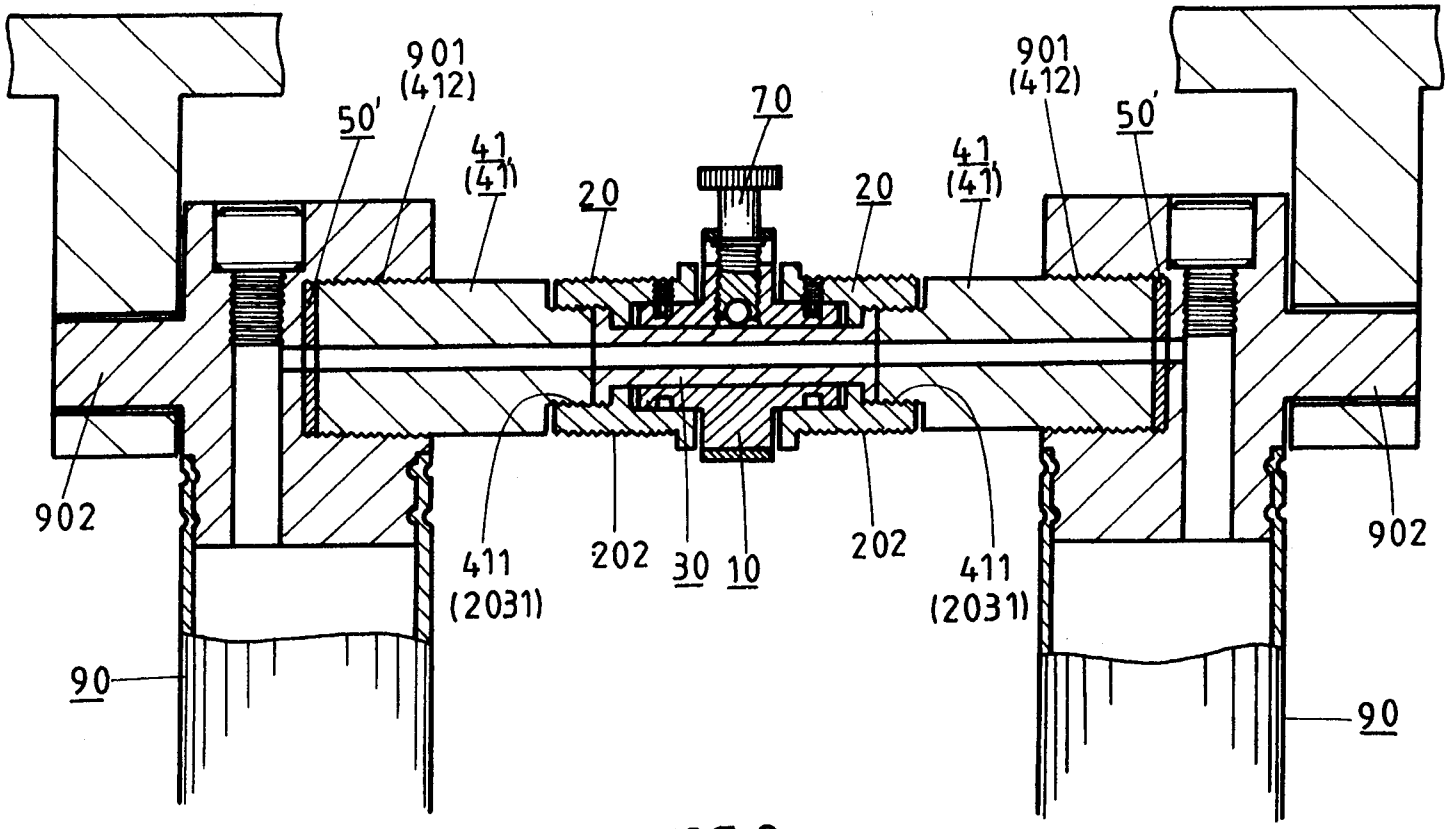
FIG. 9 is the two dimensional section delineation (2) of the pressure adjusting valve and two hydraulic cylinders of this invention.

Firstly, please refer to the FIG. 6, FIG. 7. It shows clearly that this invention is a modified mechanism for the adjusting valve on the hydraulic cylinder of a stepper. It is mainly composed of a valve 10 with two joint tendons 101 with slightly small diameter fitted at the both ends of the valve 10 respectively. A positioning groove 1011 is fitted around the joint tenon 101. In the center, there is a guide hole 102 going through. A thread hole 103 is going through the middle of the guide hole 102. The shapes of two joints 20 are similar to bolts. A hex part 201 for turning is fitted at one end of the joint. At the other end, there is fitted with a thread part 202 which can be fixed directly to the oil guide hole 901 of the hydraulic cylinder 90. In the center, there is fitted with a going through guide hole 203 of "H" shape. In the outer end of the guide hole 203, there is a thread hole 2031, while the inner end of it is a joint mortise 2032 which just can be put on the joint tenon 101. At the appropriate position around the joint mortise 2032, there is fitted with a going through positioning thread hole 204 so that a bolt 205 can be placed at appropriate depth corresponding to the positioning groove 1011 of the joint tenon 101 of the valve to ensure that the position will not loose. A flexible duct 30 with the shape like "I" is going through the guide hole 102 of the valve 10 and the guide holes 203 of the two joints 20. Both ends of it are fitted with a beetle stopper 301 respectively. In the center, there is fitted with a guide hole 302. Two positioning caps 40 with the shape like bolts are fitted with a guide hole 401 respectively so that they can be locked into the thread holes 2031 at the outer ends of the guide hole 203 of the two joints and push the beetle stoppers 301 at the both ends of the flexible flow duct 30. Two extension pipes 41 (or 41') are fitted with appropriate length and at the both ends of them, there are fitted with the thread parts 411 (or 411'), 412 (or 412') which can depends on the needs to replace the two positioning caps 40 on the two joints 20 and the oil guide holes 901 of the two hydraulic cylinders 90 (please refer to FIG. 9). Two oil seals 50 are fitted outside of the two positioning caps 40 so that the two joints 20 can be locked onto the oil guide holes 901 of the two hydraulic cylinders 90 to keep from leakage. A positioning ring 60, the inner diameter of which is slightly larger than the outer edge of the valve 10, is put on the valve 10. Around the ring there is fitted with a through hole 601. A pressure adjusting rod 70 is made of a bolt shape body directly. In addition to a handle 701 at the top end, the thread part 702 at the low end is directly going through the hole 601 of the positioning ring 60 and lock onto the tread hole 103 of the valve 10. At appropriate height, there is fitted with a positioning ring groove 703 so that the thread part 702 can be fixed by an E-shape clip 704 and tightly support at the positioning ring 60 after it is locked onto the thread hole 103 of the valve 10. A ball roller 80, which is fitted in the thread hole 103 of the valve 10 and located at the front end of the pressure adjusting rod 70 can directly touch the periphery of the flexible duct 30.

Figure 1:
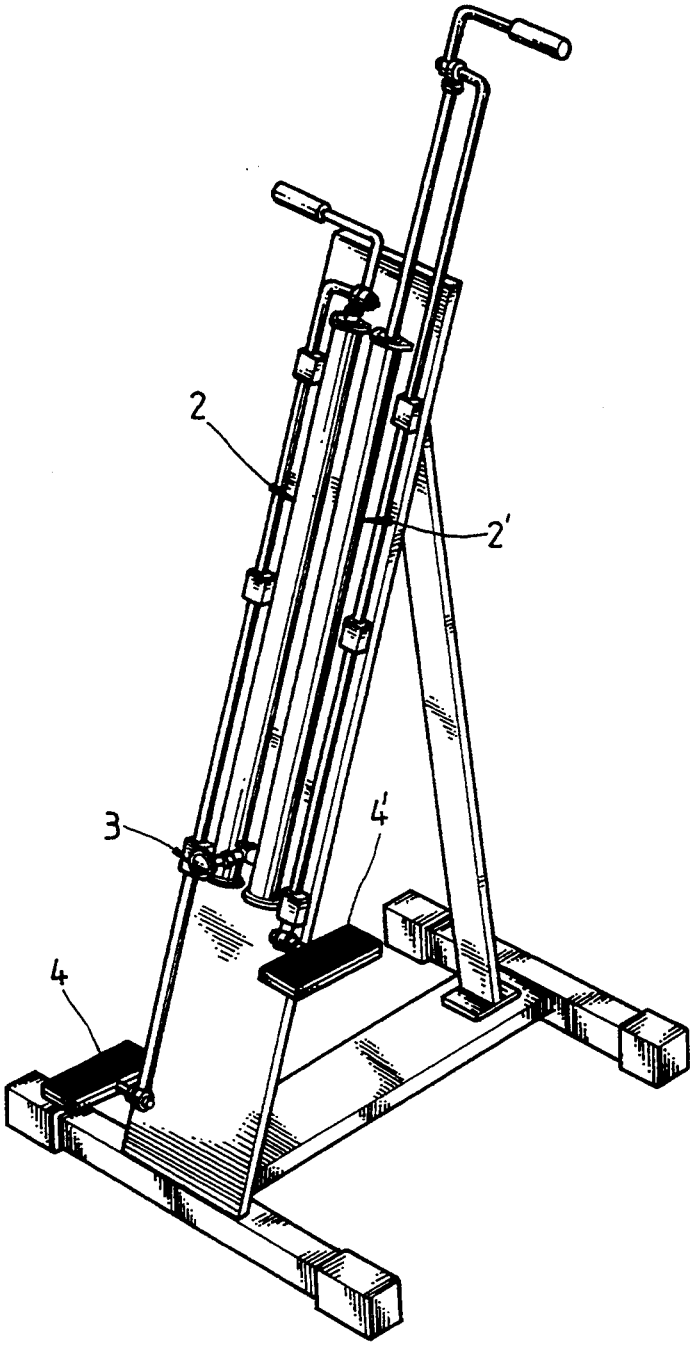
FIG. 1 (PRIOR ART)
FIG. 1 is the three dimensional delineation of a traditional pressure adjusting valve applied on the stepper when the relative distance between two cylinders is narrower in fixed condition.
Figure 2:
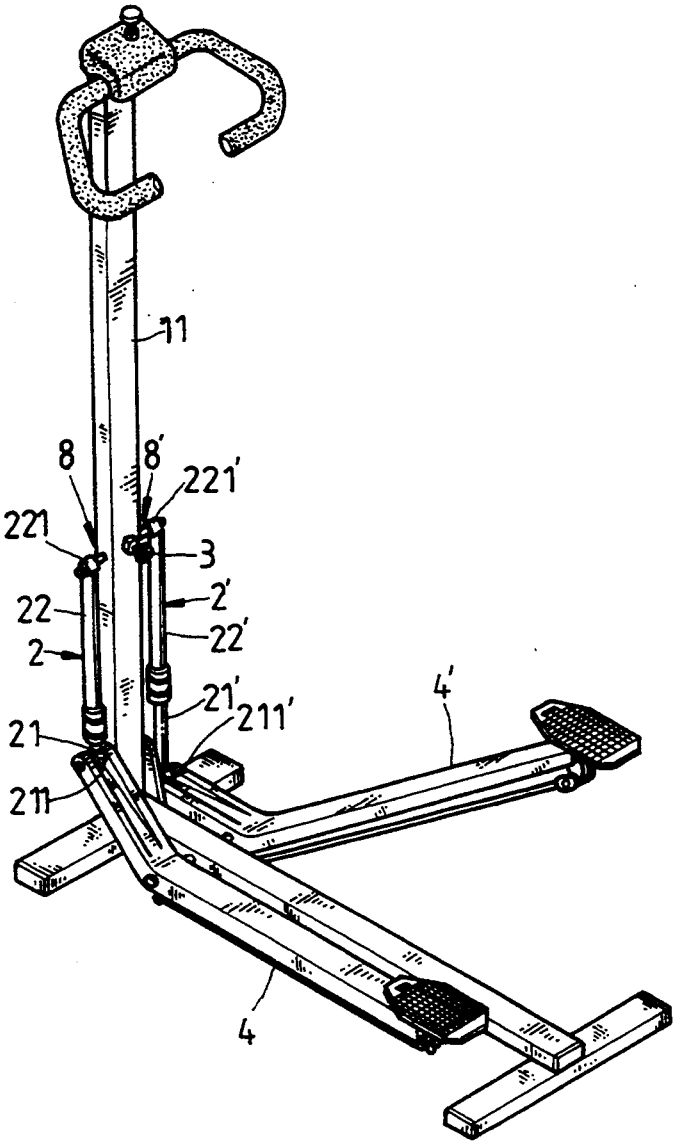
FIG. 2 (PRIOR ART)
FIG. 2 is the three dimensional delineation of a traditional pressure adjusting valve applied on the stepper when the relative distance between two cylinders is wider in freely swinging condition.
Figures 2, 3:
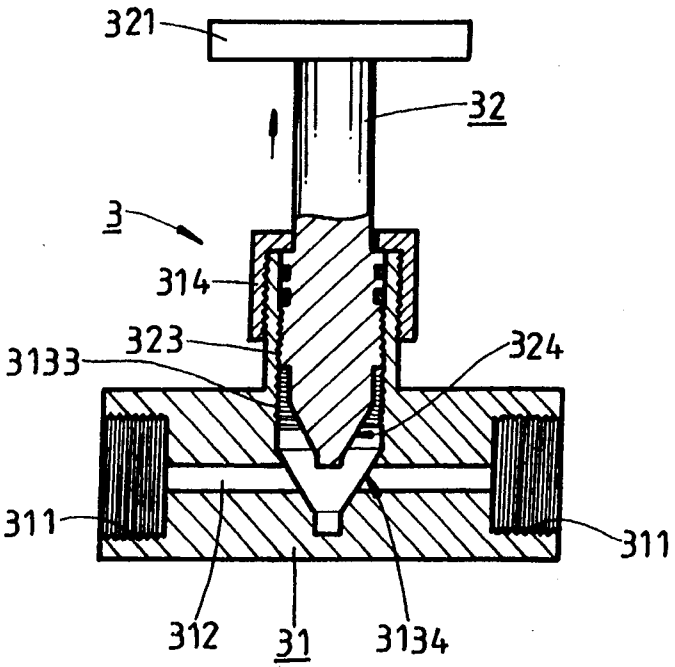
FIG.3-2 (PRIOR ART)
Figures 1, 3:
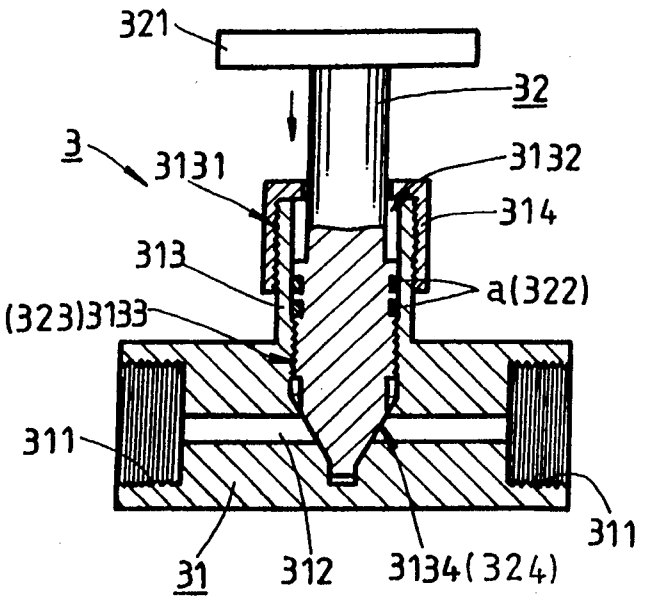
FIG.3-1 (PRIOR ART)
Figure 4:
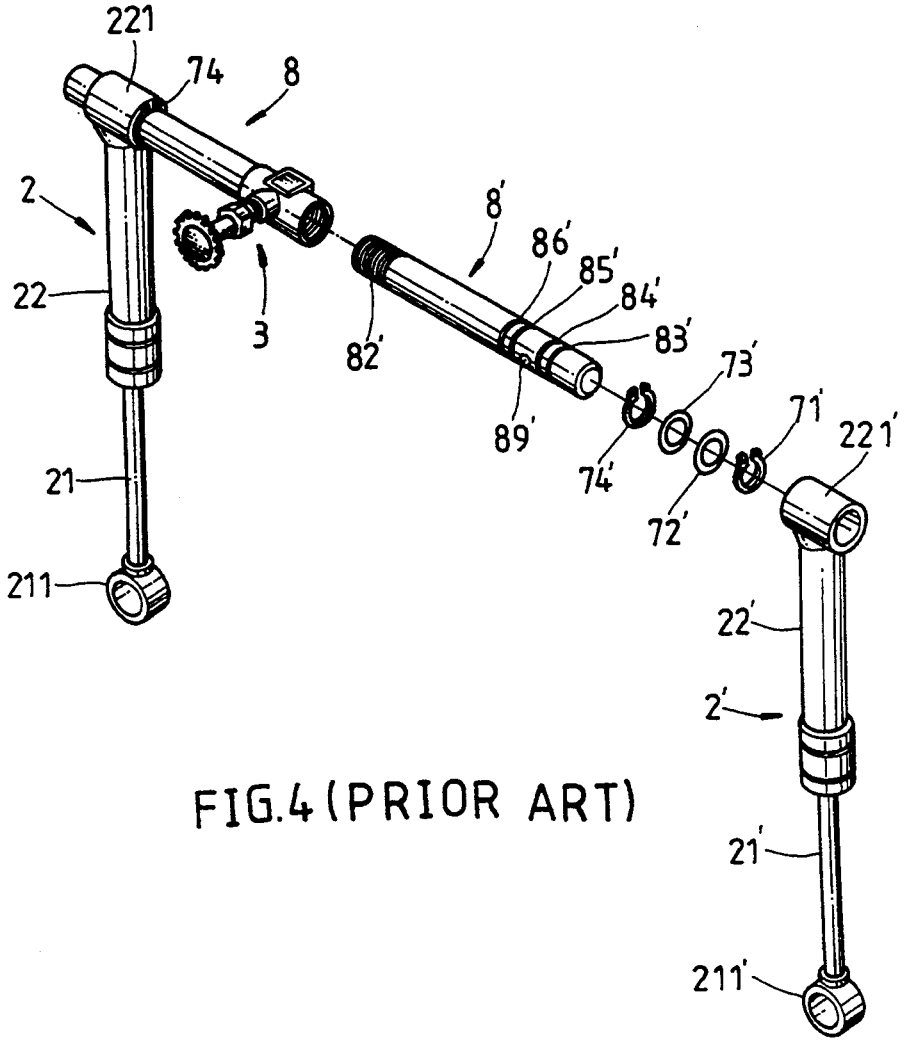
FIG.4 (PRIOR ART)
FIGS. 4, 5 are the delineation of the installation and operation of the pressure adjusting valve shown in FIG. 2.
Figure 5:
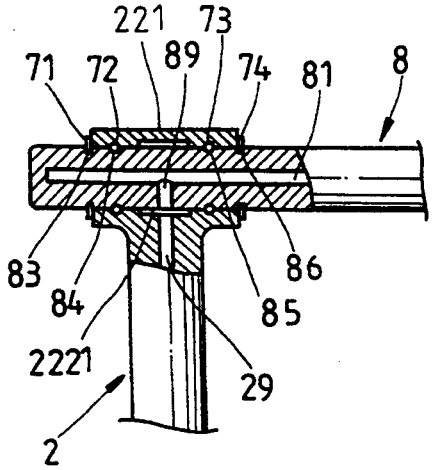
FIG.5 (PRIOR ART)
Figures 2, 8:
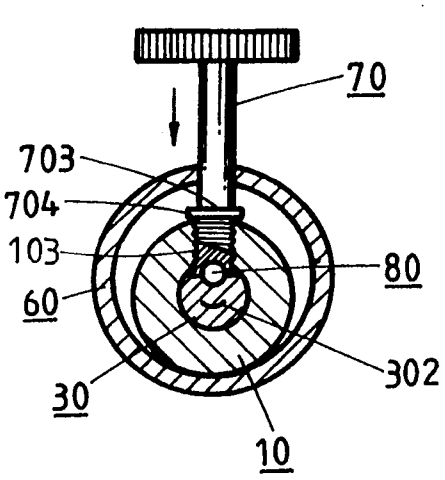
Figures 1, 8:
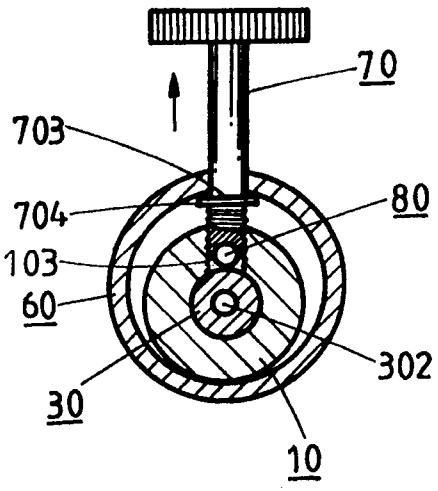

By the assembly of the above mentioned elements, as shown in FIG. 8-1, FIG. 8-2, the two joints 20 are locked on the oil guide holes 901 of the two hydraulic cylinders 90 as shown in FIG. 1 the relative distance between two cylinders is narrower in fixed condition. (As shown in FIG. 7, in this case, the ends of the two hydraulic cylinders 90 are fixed by a positioning plate B with the bolt C). Because the guide hole 302 of the flexible duct 30 is pushed by the two positioning caps 40 to keep fasten and tightly positioning and can go through to the oil guide hole 901, the hydraulic oil in the two hydraulic cylinders 90 can flow into each other directly. And because the flexible duct 30 is integrally formed and the two joints 20 locked on the oil guide hole 901 of the two hydraulic cylinders 90 is with a oil seal 50 respectively to prevent leakage. Therefore, after the joint tenons 101 at the both end of the valve 10 is put on the joint mortise 2032 of the two joints 20, it will not only have no leakage but also two joints 20 have the effect of free rotational fixing after it is positioned by a bolt 205 and the valve 10 has the effect of free rotation to adjust direction (including the direction adjustment of pressure adjusting rod 70). Because at the front end of the pressure adjusting rod 70, there is a ball roller 80 touching the periphery of the flexible duct 30 and the both end of the flexible duct 30 are fastened and positioned at the two joints 20 by two positioning caps 40, so that it will not get loose or displaced. Therefore, when the exerciser want to adjust the oil amount in the hydraulic cylinder 90 and press down the pressure adjusting rod 70, the ball roller 80 will be lowered down accordingly and push the flexible duct 30 and gradually reduce the guide hole 302 or even close it, as shown in FIG. 8-2, so that the purpose of reducing the flow amount in the two hydraulic cylinders 90 can be gained timely and practically. Contrarily, when lift up the pressure adjusting rod 70, because the flexible duct 30 itself is with a constant spring force, naturally, the ball roller 80 can be pushed up by the spring force and make the guide hole 302 open gradually or fully open, as shown in FIG. 8-1, so that the purpose of increasing the flow amount in the two hydraulic cylinders can be gained timely and practically. This invention uses the fitting of the flexible duct 30 to guide the oil flow and uses the pressure adjusting rod 70 with ball roller 80 to push the flexible duct 30 to control the flow amount in both two hydraulic cylinders appropriately and practically. From the view of practical manufacturing, for the traditional one, the defects of troublesome, inconvenience, high defect rate, low production speed and diseconomy in manufacturing resulting from the fact that it has to fit with an accurate, smooth conic hole on the valve, and an accurate, smooth conic head on the pressure adjusting rod, and the conic hole on the valve and conic head on the pressure adjusting rod must match each other closely can be improved effectively and practically. In particular, the positioning ring 60 is put on the outeredge of the valve 10 and the pressure adjusting rod 70 locked on the thread hole 103 of the valve is in the positioning ring groove 703 clamping with a E-shape clip 704, so that when the pressure adjusting rod 70 press down and causes flexible duct 30 been pushed to close by the ball roller 80, the E-shape clip 704 can stop on the periphery of the calve 10, as shown in FIG. 8-2, so that the pressure adjusting rod 70 will not be pressed down furthermore to cause any damage to the flexible duct 30. Contrarily, when the pressure adjusting rod 70 lifts up and causes the guide hole 302 of the flexible duct 30 to be fully open, the E-shape clip 704 is to be stop by the positioning ring 60, as shown in FIG. 8-1. It has the advantage that the pressure adjusting 70 will not get loose easily.

Because one end of the joint 20 of this invention is fitted with inner and outer thread (2031, 202), in addition to the above description, as shown in FIG. 7, this invention can directly connect the joint 20 to the oil guide hole 901 of the two hydraulic cylinders 90 to correspond to the condition when the distance between two hydraulic cylinders 90 is narrower. Particularly, please refer to FIG. 9, the distance between two hydraulic cylinders 90 is wider and the two hydraulic cylinders 90 are positioned by the positioning tenons 902 on their periphery. When this invention is in swinging condition as shown in FIG. 2, we only need to dismount the two positioning caps 40 and the oil seals 50, then directly mount on two extension pipes 41 and oil seals 50', or without dismounting the two positioning caps 40 and oil seals 50 but directly mount on two extension pipes 41', refer to FIG. 6, and oils seal 50, then it can get the usable effect. For the practical needs, we only need the match of two extension pipes 41 (or 41') to reach the condition of that the distance between two hydraulic cylinders 90 is wider. Therefore, this invention can be used corresponding to varied distance and the valve 10 and the pressure adjusting rod 70 have the mentioned merits. Moreover, the manufacture and the installation of the two extension pipes 41 (or 41') are with the effect of compactness, convenience, and economy. In particular, the flexible duct 30 itself has an appropriate flexibility for rotation and twist and the swinging angle of the two hydraulic cylinders of a stepper is about in 15 degree instead of a large angle over 90 degree. Obviously, this invention is suitable for both the two hydraulic cylinders in fixed condition and in swinging condition. It provides the manufacturer with more connivance, economy, and applicability.

In summary, this invention is a modified mechanism for the adjusting valve on the hydraulic cylinder of a stepper. It is obviously fulfill the requirement of providing effective needs of mutual match, oil flow into each other, flow amount adjustment of two hydraulic cylinders for general steppers. Its installation and mechanism is not complex and trivial, but the totality of operation is very practical, and is innovated among the similar products. It meets the requirements of patent application of originality, improvement, and practicability. Therefore, we are applying for the patent of this invention. We hope that it will be approved by your office and get a legal patent right.

I claim:

1. A modified mechanism for an adjusting valve of hydraulic cylinders of a stepper, comprising:

(a) a valve having joint tenons extending from opposing sides thereof, each of said joint tenons having a positioning groove formed therein, said valve having an axially directed guide hole formed therethrough and a threaded hole formed through said valve and extending normal said guide hole and in communication therewith;

(b) a pair of bolt shaped joints having opposing ends, one of said ends having a hexagonal contour and the other of said ends having a threaded portion for threaded securement in an oil guide hole of one of said hydraulic cylinders, each of said joint tenons having a joint through guide hole, having an outer threaded end portion, and an inner end portion mounted to a respective joint tenon of said valve, each of said threaded outer ends having a positioning threaded hole formed therethrough for alignment with a positioning ring groove formed within a peripheral surface of a respective joint tenon for insert of a threaded member to secure said joint tenon to said bolt shaped joint;

(c) a flexible I-shaped duct having an axially directed guide hole extending through said pair of bolt shaped joints and said valve guide hole, each of said ducts having a stopper mounted thereon;

(d) a pair of bolt shaped positioning caps, each of said positioning caps having an axially directed cap guide hole passing therethrough which engage threaded end portions of respective joint tenons and force load the stoppers at opposing ends of the flexible I-shaped duct;

(e) a pair of extension pipes having opposing threaded ends for connection between a respective bolt shaped joint and the oil guide holes of a respective hydraulic cylinder;

(f) a pair of oil seals, each of said oil seals secured to a respective positioning cap for coupling to a respective bolt shaped joint and to contact an end surface of a respective oil guide hole of a respective hydraulic cylinder;

(g) a positioning ring having an inner diameter slightly larger than an outer diameter of said valve for mounting said positioning ring thereover, said positioning ring having a positioning ring through hole formed therethrough;

(h) a pressure adjusting rod having a handle forming an upper end thereof, said pressure adjusting rod having a threaded lower end passing through said positioning ring through hole and threaded engaged to said threaded hole of said valve, a positioning ring groove within which an E-shaped clip is inserted to position the threaded positioning ring end when said pressure adjusting rod is inserted in the threaded hole of the valve; and, (i) a ball roller located internal the threaded hole of the valve and positioned at a front section of the pressure adjusting rod for contacting the periphery of said flexible duct.

* * * * *